US008678376B2

(12) United States Patent
Wang

(10) Patent No.: US 8,678,376 B2
(45) Date of Patent: Mar. 25, 2014

(54) SHEETS-SEPARATING MODULE AND MULTIFUNCTION PRINTER USING ELASTIC ELEMENT WITH DESCENDING SECTION MODULUS

(75) Inventor: Chih-Hwa Wang, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 0 days.

(21) Appl. No.: 13/479,296

(22) Filed: May 24, 2012

(65) Prior Publication Data

US 2013/0020751 A1 Jan. 24, 2013

(30) Foreign Application Priority Data

Jul. 20, 2011 (TW) ..... 100125610 A

(51) Int. Cl.
*B65H 3/52* (2006.01)

(52) U.S. Cl.
USPC ..... 271/121; 271/167

(58) Field of Classification Search
USPC ..... 271/121, 167
See application file for complete search history.

(56) References Cited

U.S. PATENT DOCUMENTS 6,086,062 A * 7/2000 Nakamura et al. ..... 271/121
6,116,589 A * 9/2000 Bortolotti ..... 271/121
6,969,168 B2 * 11/2005 Mo et al. ..... 271/121
7,434,800 B2 * 10/2008 Asada et al. ..... 271/121
7,770,885 B2 * 8/2010 Klein ..... 271/121
7,815,185 B2 * 10/2010 Claris et al. ..... 271/121
7,852,526 B2 * 12/2010 Mo et al. ..... 271/121
7,988,144 B2 * 8/2011 Coret et al. ..... 271/121
8,006,974 B2 8/2011 Hsiao
2003/0184004 A1 * 10/2003 Shiohara et al. ..... 271/121
2006/0170148 A1 * 8/2006 Goh et al. ..... 271/145
2012/0080836 A1 * 4/2012 Morisaki ..... 271/121

FOREIGN PATENT DOCUMENTS

CN 1264692 7/2006
TW 483833 4/2002
TW 528713 4/2003

OTHER PUBLICATIONS

Norton, Machine Design: An Integrated Approach, 1998, Prentice-Hall Inc., p. 194.*
Bedford et al., Statics: Engineering Mechanics, 1995, Addition-Wesley Publishing Company, Inc., p. 590.*

* cited by examiner

*Primary Examiner* — Gerald McClain
(74) *Attorney, Agent, or Firm* — Jianq Chyun IP Office

(57) ABSTRACT

A sheets-separating module and a multifunction printer using the same are provided. The sheets-separating module includes a body, an elastic element and a plurality of sheets-separating structures, in which the body has an opening, the elastic element is disposed in the opening of the body and has a first end and a second end. The first end of the elastic element connects the body, the second end thereof is a free end, and a section modulus of the elastic element is gradually descending from the second end to the first end. The sheets-separating structures are disposed on the elastic element.

7 Claims, 4 Drawing Sheets

SHEETS-SEPARATING MODULE AND MULTIFUNCTION PRINTER USING ELASTIC ELEMENT WITH DESCENDING SECTION MODULUS

CROSS-REFERENCE TO RELATED APPLICATION

This application claims the priority benefit of Taiwan application serial no. 100125610, filed on Jul. 20, 2011. The entirety of the above-mentioned patent application is hereby incorporated by reference herein and made a part of this specification.

BACKGROUND OF THE INVENTION

1. Field of the Invention

The invention generally relates to a sheets-separating module and a multifunction printer using the same, and more particularly, to a sheets-separating module and a multifunction printer using the same which have stable sheets-separating effect and are not easy to get paper jams.

2. Description of Related Art

Along with the developments of science and technology and interconnected social network, various electronic and electric products have become indispensable tools for daily life. For example, during working in an office, common office equipments including computer, printer, fax machine, photocopier and the like are indispensable, in which the operation efficiency of equipments using paper sheets such as printer, photocopier and fax machine would be affected by the paper-feeding function thereof.

Taking a multifunction printer with both photocopy and printing functions as an example, an automatic paper-feeding device is disposed on the multifunction printer to drive the carried blank paper sheets entering into the multifunction printer for printing operation. Prior to printing, a user needs to place some paper sheets on the paper-feeding device (for example, a sheets-bearing tray). Then, during printing, an employed paper-feeding device conveys the paper sheets in the multifunction printer so that a printing device forms images on a paper sheet.

FIG. 1 is a partial schematic diagram of a conventional multifunction printer and FIG. 2 is a schematic diagram of the sheets-separating module of FIG. 1. Referring to FIGS. 1 and 2, there is a bottom board 101 in the multifunction printer 100 for bearing paper sheets. A plurality of rollers 150 are disposed over the bottom board 101 for driving the paper sheets to move forward; meanwhile, a sheets-separating module 103 disposed on the bottom board 101 separates the paper sheets one by one.

In more details, an elastic element 103*a* of the sheets-separating module 103 is a cantilever, and the width and the thickness of the elastic element are the same from a connection end 103*b* to a free end 103*c*. With the above-mentioned structure design, the sheets-separating module 103 is very easy to be affected by the number of the paper sheets in the sheets-bearing tray. Moreover, since the connection end 103*b* connects a body 103*d* of the sheets-separating module 103, so that the stiffness of the connection end 103*b* is larger than the stiffness of the free end 103*c*. During conveying the paper sheets 105, although the forces applied by the paper sheets 105 at the connection end 103*b* and the free end 103*c* are the same as each other, the deformation of the connection end 103*b* is less than the deformation of the free end 103*c*. On the other hand, when the paper sheets borne in the sheets-bearing tray are fewer, a larger force is needed to make the elastic element 103*a* of the sheets-separating module to deform, so that the leading edges of the paper sheets 105 are easily damaged.

SUMMARY OF THE INVENTION

Accordingly, the invention is directed to a sheets-separating module with a stable sheets-separating effect.

The invention is also directed to a multifunction printer for avoiding paper jams.

The invention provides a sheets-separating module suitable for and disposed in a multifunction printer. The sheets-separating module includes a body, an elastic element and a plurality of sheets-separating structures, in which the body has an opening, the elastic element is disposed in the opening of the body and has a first end and a second end. The first end of the elastic element connects the body, the second end is a free end, and a section modulus of the elastic element is gradually descending from the second end to the first end. The sheets-separating structures are disposed on the elastic element.

In an embodiment of the sheets-separating module of the present invention, the above-mentioned section modulus gradually descending from the second end to the first end is implemented by descending thickness but with a fixed width, or by descending width but with a fixed thickness.

In an embodiment of the sheets-separating module of the present invention, the above-mentioned second end is protruded from a top surface of the body.

In an embodiment of the sheets-separating module of the present invention, the above-mentioned sheets-separating structures are in saw-teeth shape.

In order to achieve the above-mentioned or other objectives, the invention also provides a multifunction printer, which includes a case body, a sheets-bearing tray and a sheets-separating module. The sheets-bearing tray used to bear paper sheets is disposed at the case body. The sheets-separating module is disposed at the case body and located beside the sheets-bearing tray. The sheets-separating module includes a body, an elastic element and a plurality of sheets-separating structures. The body is disposed at the case body and has an opening. The elastic element is disposed in the opening of the body and has a first end and a second end, in which the first end connects the body, the second end is a free end, and a section modulus of the elastic element is gradually descending from the second end to the first end. The sheets-separating structures are disposed on the elastic element.

In an embodiment of the multifunction printer of the present invention, the above-mentioned section modulus gradually descending from the second end to the first end is implemented by descending thickness but with a fixed width, or by descending width but with a fixed thickness.

In an embodiment of the multifunction printer of the present invention, the above-mentioned second end is protruded from a top surface of the body.

In an embodiment of multifunction printer of the present invention, the above-mentioned sheets-separating structures are in saw-teeth shape.

In an embodiment of the multifunction printer of the present invention, the multifunction printer further includes a set of paper-feeding rollers disposed at the case body for driving the paper sheets borne by the sheets-bearing tray.

Based on the description above, the section modulus of the elastic element of the sheets-separating module in the invention is gradually descending towards the free end so that under a same conveyance force for paper sheets, the strained deformation amounts at any position of the elastic element from the first end to the second end due to the forces applied by the paper sheets are equivalent, which can increase the stability of sheets-separating operation effect and further reduce the probability of paper jams of the multifunction printer employing the sheets-separating module.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
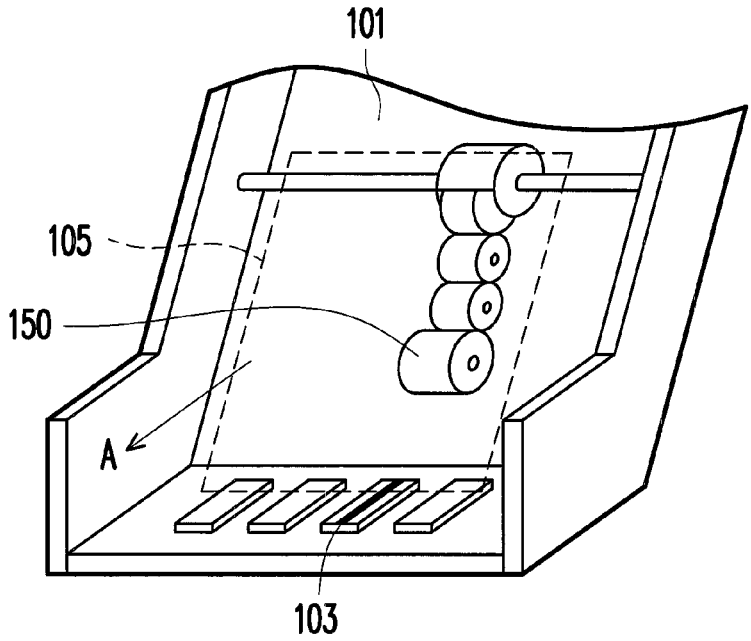
FIG. 1 (RELATED ART)
FIG. 1 is a partial schematic diagram of a conventional multifunction printer.
Figure 2:
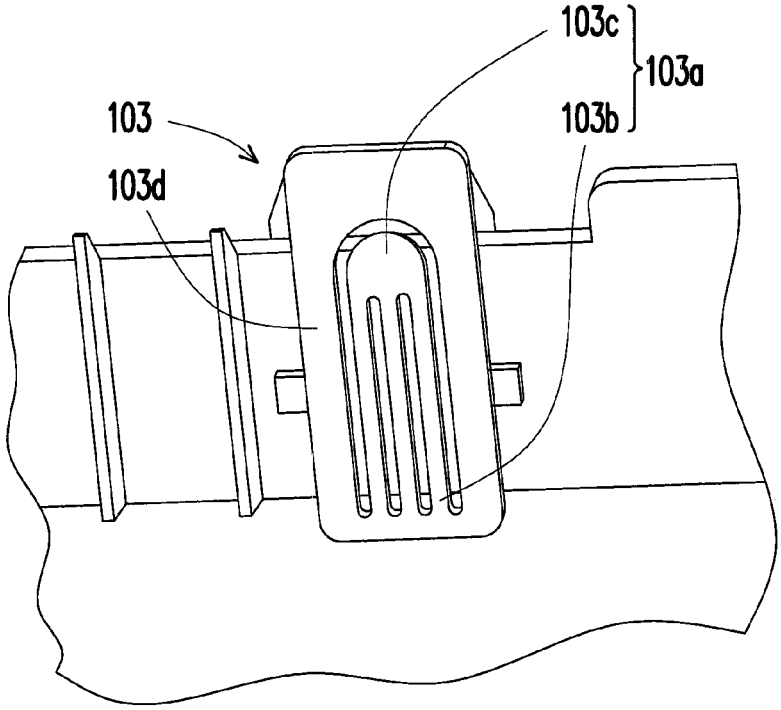
FIG. 2 (RELATED ART)
FIG. 2 is a schematic diagram of the sheets-separating module of FIG. 1.
Figure 3:
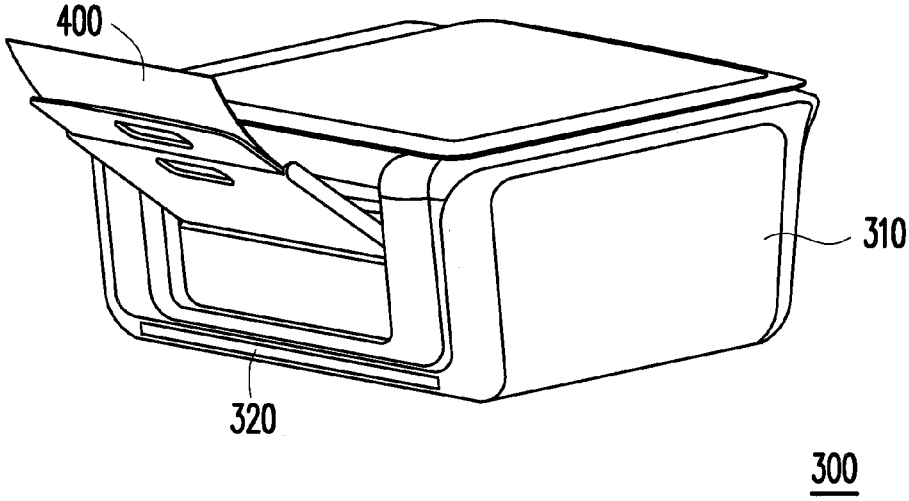
FIG. 3 is a schematic diagram of a multifunction printer according to an embodiment of the invention.
Figure 4:
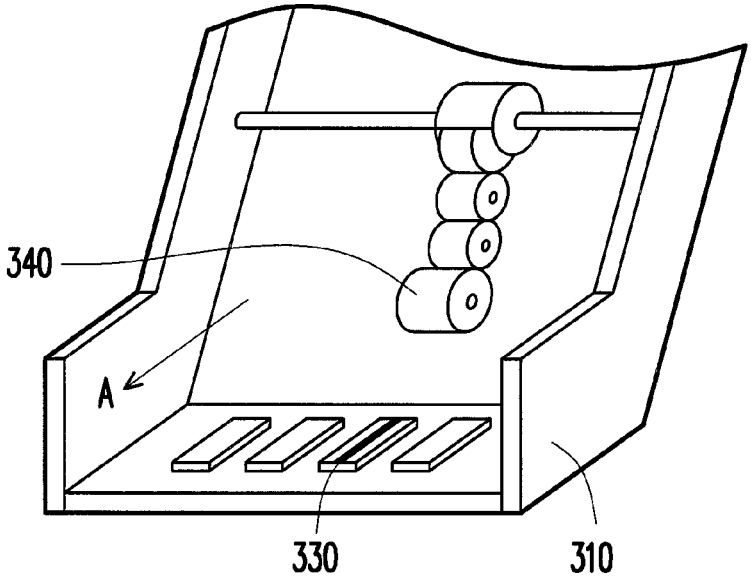
FIG. 4 is a partial schematic diagram of the multifunction printer of FIG. 3.
Figure 5:
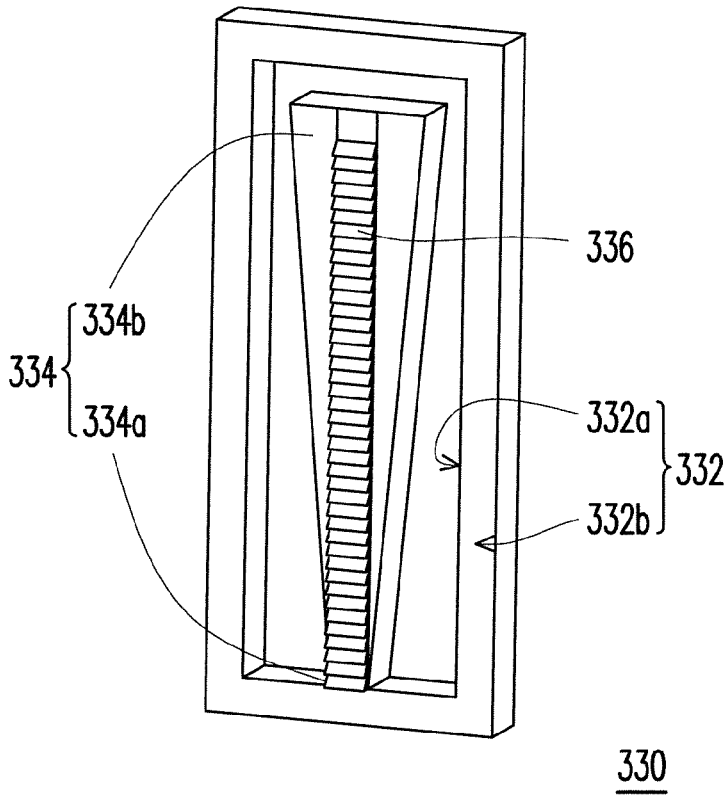
FIG. 5 is a schematic diagram of the sheets-separating module used in the multifunction printer of FIG. 3.

FIG. 3 is a schematic diagram of a multifunction printer according to an embodiment of the invention, FIG. 4 is a partial schematic diagram of the multifunction printer of FIG. 3 and FIG. 5 is a schematic diagram of the sheets-separating module used in the multifunction printer of FIG. 3. Referring to FIGS. 3-5, a multifunction printer 300 includes a case body 310, a sheets-bearing tray 320 and a sheets-separating module 330. The sheets-bearing tray 320 is disposed at the bottom of the case body 310 and used for bearing paper sheets 400, in which the sheets-bearing tray 320 of the embodiment can be drawn out relative to the case body 310 for a user to place the paper sheets 400 to be printed. People skilled in the art can change the relative position between the sheets-bearing tray 320 and the case body 310 and the layout thereof according to the real requirement, such as disposing the sheets-bearing tray 320 pivoted to the case body 310, and therefore the sheets-bearing tray 320 can be open relative to the case body 310 for bearing paper sheets 400. The sheets-separating module 330 is disposed at the case body 310 and located beside the sheets-bearing tray 320. The sheets-separating module 330 includes a body 332, an elastic element 334 and a plurality of sheets-separating structures 336. The body 332 is disposed at the case body 310 and has an opening 332*a*, the elastic element 334 is disposed in the opening 332*a* of the body 332 and has a first end 334*a* and a second end 334*b*, in which the first end 334*a* connects the body 332, the second end 334*b* is a free end and can be slightly protruded from a top surface 332*b* of the body 332. In addition, the sheets-separating structures 336 are disposed on the elastic element 334. In the embodiment, the sheets-separating structures 336 are in saw-teeth shape to achieve sheets-separating effect. It should be noted that the section modulus of the elastic element 334 in the embodiment is gradually descending from the second end 334*b* to the first end 334*a*, by which the strained deformation amounts of the elastic element 334 at any position from the first end 334*a* to the second end 334*b* due to applied forces are equivalent. In this way, the stability of sheets-separating operation effect of the sheets-separating module 330 is increased and the printing quality of the multifunction printer 300 is advanced.

In the embodiment, the section modulus gradually descending from the second end 334*b* to the first end 334*a* is implemented by descending width but with a fixed thickness. As shown by FIG. 5, the elastic element 334 roughly has a triangle plate shape.

Continuing to FIGS. 3-5, the multifunction printer 300 further includes a set of paper-feeding rollers 340 disposed in the case body 310, in which the set of paper-feeding rollers 340 is for driving the paper sheets 400 borne by the sheets-bearing tray 320. The disposing position of the set of paper-feeding rollers 340 can be changed correspondingly to the disposing position of the sheets-bearing tray 320, which the invention is not limited to.

Figure 6:
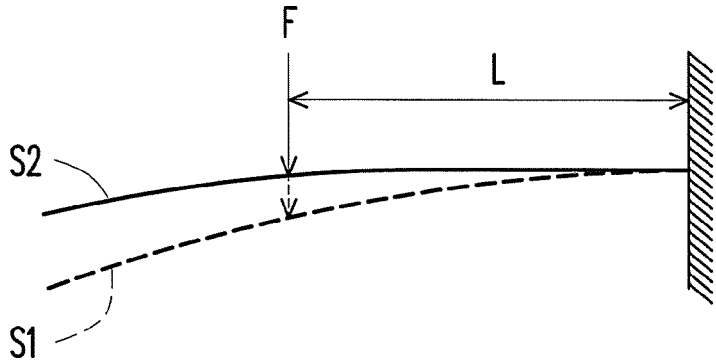
FIG. 6 is schematic graphic showing two deformation curves of elastic elements adapted in a conventional multifunction printer and a multifunction printer of the embodiment during printing.

FIG. 6 is schematic graphic showing two deformation curves of elastic elements adapted in a conventional multifunction printer and a multifunction printer of the embodiment during printing. Referring to FIGS. 4-6, when the paper sheets 400 are placed at the sheets-bearing tray 320, a part of the paper sheets 400 applies a press force onto the elastic element 334. When the multifunction printer 300 performs printing operation, the set of paper-feeding rollers 340 rotates to bring the paper sheets 400 (shown in FIG. 3) moving and the multifunction printer 300 enters a printing procedure. The conveyance force for the set of paper-feeding rollers 340 to drive the paper sheets 400 is fixed. Under the fixed conveyance force, regardless the quantity of the paper sheets 400 in the sheets-bearing tray 320, the deformation amounts of the elastic element 334 can be moderated by means of the above-mentioned design that the width of the elastic element 334 is gradually descending from the second end 334*b* to the first end 334*a* while keeping the thickness thereof fixed. In FIG. 6, S2 is a deformation curve of the embodiment and S1 is a deformation curve of a conventional sheets-separating module. It can also be seen from FIG. 6 that under a same conveyance force F and a same force-applying distance L, the deformation amounts of the elastic element 334 in the embodiment is more moderated than the prior art, which means the sheets-separating effect is more stable and the printing quality of the multifunction printer 300 is advanced.

Figure 7A:
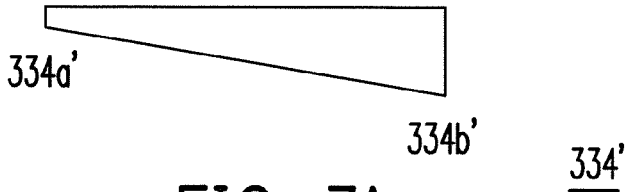
FIG. 7 is a schematic diagram of an elastic element according to another embodiment of the invention.
Figure 7B:
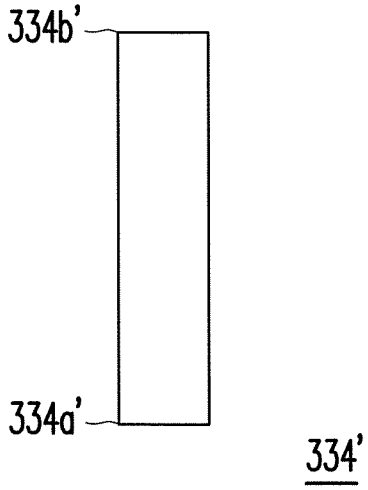

FIG. 7 is a schematic diagram of an elastic element according to another embodiment of the invention. Referring to FIG. 7, an elastic element 334' can be designed to keep the width thereof fixed while the thickness thereof is gradually descending from the second end 334*b'* to the first end 334*a'*, which changes the section modulus of the elastic element 334', and the stable sheets-separating effect can also be achieved.

In summary, one feature of the sheets-separating module of the invention is to have varies section modulus along an end to the other end of the elastic element of the sheets-separating module, and therefore under a fixed conveyance force for paper sheets, the strained deformation amounts of the elastic element are equivalent and stable and so as to achieve a stable sheets-separating effect. The multifunction printer employing the above-mentioned sheets-separating module can effectively reduce probability of paper jams and thereby advance printing quality.

It will be apparent to those skilled in the art that the descriptions above are several preferred embodiments of the invention only, which does not limit the implementing range of the invention. Various modifications and variations can be made to the structure of the invention without departing from the scope or spirit of the invention. The claim scope of the invention is defined by the claims hereinafter.

What is claimed is:

1. A sheets-separating module, suitable for and disposed in a multifunction printer, comprising:

a body, having an opening;

an elastic element, disposed in the opening of the body and having a first end and a second end, wherein the first end connects to the body, the second end is a free end, and one of the group consisting of width and thickness is linearly descending along the entire length of the elastic element from the second end to the first end with the other of the group consisting of width and thickness remaining fixed; and a plurality of sheets-separating structures, disposed on the elastic element.

2. The sheets-separating module as claimed in claim 1, wherein the second end is protruded from a top surface of the body.

3. The sheets-separating module as claimed in claim 1, wherein the sheets-separating structures have a saw-teeth shape.

4. A multifunction printer, comprising:

a case body;

a sheets-bearing tray, disposed at the case body and suitable to bear at least one paper sheet;

a sheets-separating module, disposed at the case body and located beside the sheets-bearing tray, comprising:

a body, disposed at the case body and having an opening;

an elastic element, disposed in the opening of the body and having a first end and a second end, wherein the first end connects to the body, the second end is a free end, and one of the group consisting of width and thickness is linearly descending along the entire length of the elastic element from the second end to the first end with the other of the group consisting of width and thickness remaining fixed; and a plurality of sheets-separating structures, disposed on the elastic element.

5. The multifunction printer as claimed in claim 4, wherein the second end is protruded from a top surface of the body.

6. The multifunction printer as claimed in claim 4, wherein the sheets-separating structures have a saw-teeth shape.

7. The multifunction printer as claimed in claim 4, further comprising a set of paper-feeding rollers disposed at the case body for driving the paper sheets borne by the sheets-bearing tray.

* * * * *